US005887583A

United States Patent [19]

Irwin et al.

[11] Patent Number: 5,887,583

[45] Date of Patent: Mar. 30, 1999

[54] MASS FLOW CONTROL SYSTEM AND METHOD FOR ASPHALT PLANT

[75] Inventors: Bruce C. Irwin, Palmyra; Fred L. Fuhrman, Jonestown, both of Pa.

[73] Assignee: Hauck Manufacturing Company, Lebanon, Pa.

[21] Appl. No.: 688,784

[22] Filed: Jul. 31, 1996

[51] Int. Cl.[6] ..... E01C 19/45

[52] U.S. Cl. ..... 126/343.5 A; 126/343.5 R; 431/12; 431/37; 431/90; 137/9

[58] Field of Search ..... 431/12, 79, 90, 431/18, 36, 80; 432/24, 37, 105; 137/9; 126/343.5 A, 343.5 R

[56] References Cited

U.S. PATENT DOCUMENTS

| | | | |
|---|---|---|---|
| 1,713,111 | 5/1929 | Noland . | |
| 2,777,513 | 1/1957 | Cooper . | |
| 2,932,350 | 4/1960 | Cooper . | |
| 3,284,615 | 11/1966 | Yetter . | |
| 3,577,648 | 5/1971 | Brock . | |
| 3,614,071 | 10/1971 | Brock . | |
| 3,693,945 | 9/1972 | Brock . | |
| 3,809,373 | 5/1974 | Brock . | |
| 3,814,570 | 6/1974 | Guigues et al. . | |
| 3,960,320 | 6/1976 | Slater . | |
| 4,033,712 | 7/1977 | Morton . | |
| 4,043,742 | 8/1977 | Egan et al. . | |
| 4,157,238 | 6/1979 | van Berkum . | |
| 4,174,949 | 11/1979 | Swisher, Jr. . | |
| 4,249,886 | 2/1981 | Bush . | |
| 4,260,363 | 4/1981 | Cratin, Jr. . | |
| 4,293,228 | 10/1981 | Swisher, Jr. et al. . | |
| 4,309,168 | 1/1982 | Prill et al. | 431/12 X |
| 4,348,169 | 9/1982 | Swithenbank et al. . | |
| 4,359,950 | 11/1982 | Leffler et al. . | |
| 4,362,499 | 12/1982 | Nethery | 431/12 |
| 4,375,950 | 3/1983 | Durley, III . | |
| 4,396,369 | 8/1983 | Kaessmann . | |
| 4,474,549 | 10/1984 | Capone . | |
| 4,479,774 | 10/1984 | Stough . | |
| 4,486,166 | 12/1984 | Nelson et al. . | |
| 4,498,863 | 2/1985 | Hanson et al. . | |
| 4,509,912 | 4/1985 | van Berkum . | |
| 4,533,315 | 8/1985 | Nelson . | |
| 4,545,009 | 10/1985 | Muraki et al. . | |
| 4,585,161 | 4/1986 | Kusama et al. . | |
| 4,645,450 | 2/1987 | West . | |
| 4,717,071 | 1/1988 | Capone . | |
| 4,749,122 | 6/1988 | Shriver et al. . | |
| 4,770,627 | 9/1988 | Yoshino . | |
| 4,787,938 | 11/1988 | Hawkins . | |
| 4,838,295 | 6/1989 | Smith et al. | 137/9 |
| 4,910,540 | 3/1990 | Murray . | |
| 4,913,552 | 4/1990 | Bracegirdle . | |
| 4,919,538 | 4/1990 | Swisher, Jr. . | |
| 4,989,986 | 2/1991 | Swisher, Jr. . | |
| 4,994,959 | 2/1991 | Ovenden et al. . | |
| 5,160,259 | 11/1992 | O'Hara et al. . | |

OTHER PUBLICATIONS

North American 8080, Bulletin 8080, Nov. 1993.
North American 8081, Bulletin 8081, May, 1994. pp. 1–3.

*Primary Examiner*—Larry Jones
*Attorney, Agent, or Firm*—Evenson, McKeown, Edwards & Lenahan, P.L.L.C.

[57] ABSTRACT

As electronic programmable valve positioning linkage for a burner used in a hot mix asphalt plant is associated with fuel, air and optionally flue gas recirculation valve motors. To avoid an undesired rich condition which might result in an explosive condition, the linkage employs a program logic which changes a valve position, depending on increase or decrease of the burner output, in response to a temperature controller and thereby maintain an acceptable lean condition. The air valve motor is controlled by the temperature controller when burner output is to be increased with the fuel valve motor following the air valve motor, and the fuel valve motor is controlled when the burner output is to be decreased with the air valve motor following the fuel valve motor. In conjunction with the linkage, a mass flow system can be provided to calculate fuel/air and/or flue gas recirculation ratios based upon measurement of air flow, fuel flow and flue gas flow. In such a mass flow system, the linkage acts as a backup for maintenance purposes and the like.

15 Claims, 3 Drawing Sheets

MASS FLOW CONTROL SYSTEM AND METHOD FOR ASPHALT PLANT

BACKGROUND AND SUMMARY OF THE INVENTION

The present invention relates to a system and method for burners, and more particularly, to a system and method for mass flow control and for characterizing the fuel/air ratio for a burner used on dryers for hot mix asphalt plants and the like such that explosive and very lean conditions are avoided and continued operation of the dryer takes place in the event of malfunction of the mass flow measuring equipment.

A hot mix asphalt plant is typically used to produce asphalt pavement and includes a feed bin system for proportioning and conveying aggregate mixes into the plant, a rotating dryer drum to heat and dry the aggregate, a burner/combustion heating system to provide heat to aggregate in the rotating dryer drum, a flue gas exhaust system for conveying and filtering the exhaust gas from the dryer/heating drum, a mixing device to mix the hot aggregate with the asphalt cement, and a conveyor to move the hot mix asphalt to the user's trucks.

Generally speaking, the burner has separate air and fuel valves and associated control motors such as found in the "EcoStars" system made by Hauck Manufacturing Co., the assignee of the present application. These fuel valves can be of the butterfly type for natural gas control or, in the case of liquid fuel, an oil control valve such as the Hauck "Microvalvel". The combustion air control valve in the Hauck "EcoStar" can be a rotating multi-vane inlet fan damper or a multiple blade fan outlet damper. These different valve have different "percentage of opening versus percentage of flow" curves, and may also have different speed control valve drive motors such as Models EA-57, EA-71 or EA-73 made by Barber-Colman.

Dryers or aggregate dryers for use on hot mix asphalt plants frequently used either a mechanically or electronically linked fuel and air valves to maintain correct fuel/air ratios. These known fuel/air rationing systems typically did not, however, have the capability of varying the fuel/air ratio at in-between points in the travel of the valves without affecting the fuel/air ratios at the other points.

More recent electronic systems which have programmable relationships between the fuel and air valves and thereby solve the problem of in-between point adjustable fuel/air ratios without affecting the other point relationships. The ability to characterize the fuel to the air is necessary because different types of valves frequently have different flow-versus-position relationships which substantially affect the fuel and air ratios. For example, if the fuel valve has 50% of its flow at 40% opening and the air valve has 50% of its flow at 60% opening, then the proper fuel/air positioning setting is 60% opening on the air with 40% opening on the fuel valve. such electronic control device for use in the dryer burner combustion industry is described in U.S. Pat. No. 5,190,454. That known system uses a programmable logic controller or PLC for setting the characterizing relationships based on flue gas analysis.

Another electronic control is offered by North American Mfg. Co. as Models 8080/8081 controller. However, the known mechanical or electronic control approaches have not recognized the need to limit the danger of rich operation which is a matter of particular concern on a dryer or aggregate dryer.

In particular, previous electronic controls used either the fuel valve or the air valve as the temperature-controller valve and the other of the valves as the follower. In the case of the fuel valve always being controlled during a temperature increase the fuel will first increase first and then the air valve will follow. This can lead to a rich condition, particularly, as is often the case, if the fuel drive motor drive is faster than the air valve drive motor. This momentary rich condition creates a dangerous situation in a dryer because the dryer operates below typical auto-ignition temperatures for most fuels and additional air for completing the combustion is frequently available downstream of the combustion section. A combustible mixture would be created downstream of the combustion zone in the exhaust ductwork and could explode if an ignition source were present. This momentary rich condition also creates unwanted emissions of unburned hydrocarbons or carbon monoxide.

It is, therefore, an object of the present invention to prevent as much as possible the occurrence of undesirable rich and lean operating conditions.

It is another object of the present invention to provide flue gas recirculation for further $NO_x$ emission reduction.

It is yet another object of the present invention to measure and maintain proper fuel/air ratios even with malfunctioning of flow measuring components.

The foregoing objects have been achieved in accordance with the present invention by providing and electronic programmable linkage system using, for example, an integrated or stand along PLC which assures that the air and fuel valves do not move in such a way to create a momentary but dangerous rich condition as the system moves from one firing rate to another.

In particular, the present invention reduces the risk of this rich condition by incorporating logic to change the valve being driven by the temperature controller to maintain a leaner condition during modulation. In order to maintain a lean condition, the air valve is controlled by the temperature controller when a burner output increase is desired, and the fuel valve is controlled by the temperature controller when a decrease of burner output is desired. Consequently, the air "leads" the fuel on increasing demand, and the fuel "leads" the air for a decrease in burner output.

One advantage of the present invention is that an unwanted rich condition is prevented to the extent possible. In accordance with another aspect of the present invention, if one control valve drive motor is faster than the other control valve drive motor, the present invention prevents the valve driven by the slower motor from lagging too far behind the other valve when moving to a new position. This valve-lagging condition could momentarily create undesirable flue gas emissions of lean combustion products of combustion. To reduce this lean condition as much as possible, the present invention uses logic which stops the valve being driven by the temperature controller if the follower valve lags too far behind.

The amount of acceptable lag is adjustable within the skill in this art and is set in the PLC. For example, the amount of acceptable lag might be 5% of the range of valve motor travel. That is, if the air valve drive motor was being driven due to a desire for an increase in burner output and it had travelled to 50% of its travel and the fuel valve motor was at 44% of its travel, then the air valve would be interrupted from going to 51% until the fuel valve had arrived at 45% of its travel. Of course, this example is merely illustrative and is not intended to limit the principles of the present invention.

Another, more sophisticated embodiment of the present invention is describable as a mass flow system with electronic programmable valve positioning of the foregoing type as a back-up. The mass flow system also includes a system for controlling fuel and air ratio of burners by measuring the fuel flow, the air flow, and, where appropriate, flue gas flow. With measurement of each of the flows, the system can calculate the correct fuel/air ratio and, if appropriate, the flue gas recirculation ratio. The mass flow system according to this embodiment also includes the same apparatus and method described above for preventing rich operation when a change in firing rate is required. The only difference is that instead of comparing the valve motor positions as the electronic programmable linkage does, the PLC compares the measured fuel an air flows to the calculated desired fuel air ratio.

The above-described electronic programmable linkage used mass flow system of this second embodiment can be used in the event of a problem or required maintenance with the flow measuring equipment to allow for continued operation of the dyer without a serious interruption. This switch over to the programmable electronic positioning can occur automatically whenever the mass flow logic detects a problem with the flow sensing transmitters (such as zero output during operation) or it can be enabled below at any demand rate such as, for example, 10% of flow demand. For example, at 9% of flow demand, the system would automatically use programmable electronic valve positioning. This can be particularly advantageous because many flow transmitters, such as differential pressure-to-current transmitters, are limited in accurate flow sensing to a 6:1 turndown range or 16.7% of flow demand.

DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
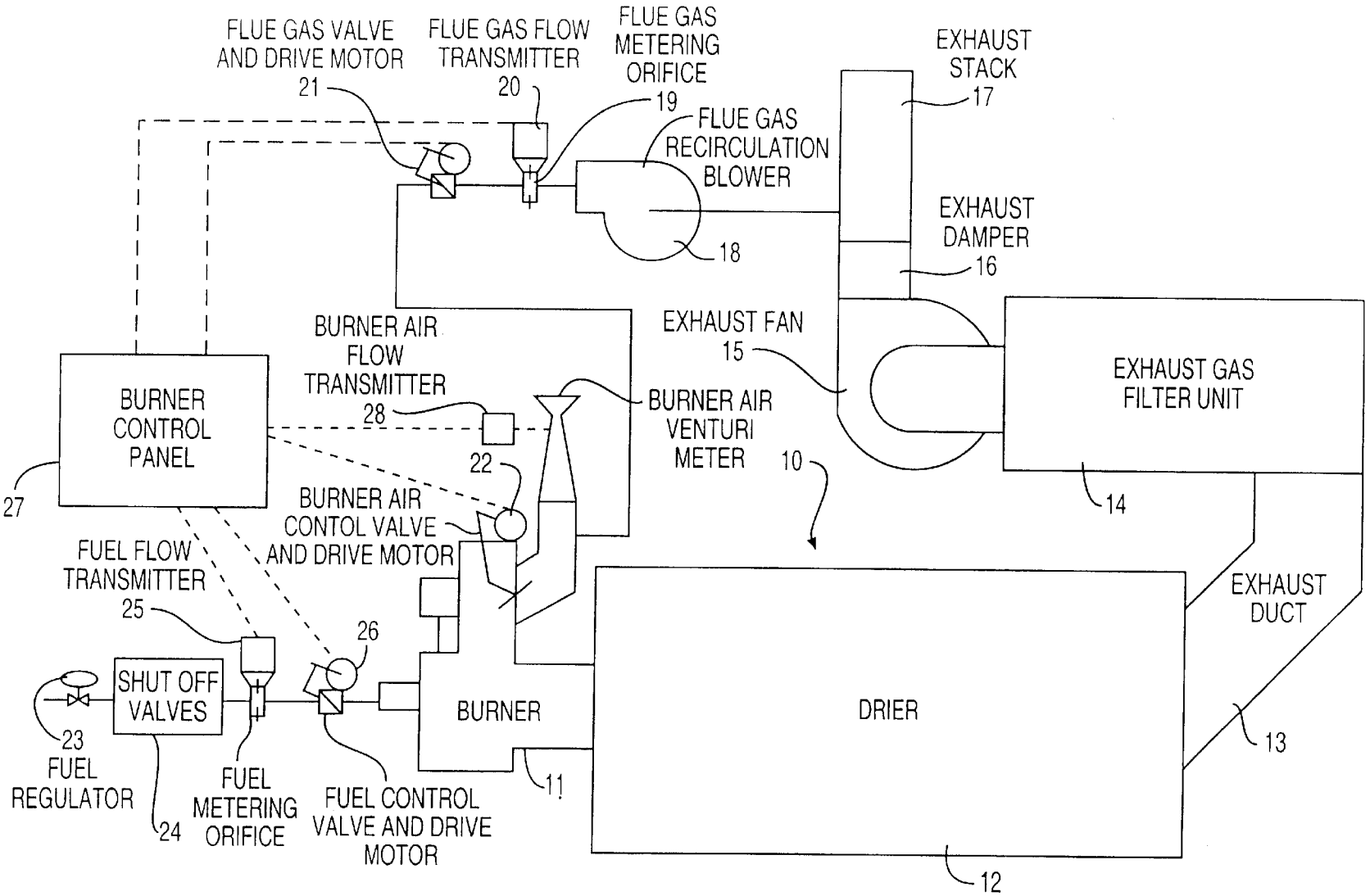
FIG. 1 is a schematic drawing of a hot mix asphalt plant using a mass flow control in which a burner control panel incorporates an electronic programmable linkage in accordance with the present invention.

Referring now to FIG. 1, a hot asphalt plant system of generally known configuration is designated by the numeral 10 and consists of a burner 11, a dryer 12, an exhaust duct 13, and exhaust gas filter unit 14, an exhaust fan 15, an exhaust damper 16 and an exhaust stack 17. Optionally, flue gas recirculation can be provided via a blower 18 connected with the exhaust stack 17, a flue gas metering orifice 19 with an associated flow transmitter 20, a flue gas valve and drive motor system 21 for selectively supplying recirculated flue gas to the burner 11 via a control valve and drive motor system 22. Fuel is supplied to the burner 11 through a fuel regulator 23, shut off valves 24, fuel metering orifice 25, and a fuel control valve and drive method system 26. A burner control panel 27 is electrically connected to receive signals from the flue gas flow transmitter 20, a burner air flow transmitter 28 and the fuel flow transmitter 25 and to send appropriate command signals to the flue gas valve and drive motor system 21, the fuel control valve and drive motor system 26 and the burner air control valve and drive motor system 22. The constructional details and operation of the individual components described above are generally well known to those skilled in this art and further details are unnecessary.

The burner control panel 27 can be similar in type to Model BCS 5000 made by Hauck Manufacturing Co. but with both mass flow control and a programmable electronic linkage back-up control logic integrated. Alternatively, without departing from the scope of the present invention, the latter can be contained in a stand-alone PLC such as the Model DL 405 of PLC Direct incorporating standard analog input and output relay module blocks to receive flow and position signals and to send control instructions to the valve and motor systems. With mass flow operation, flow sensing of the combustion air is provided by a commercial Hauck venturi orifice and an electronic differential pressure transmitter such as Dresser Industries' Model XLDP. The fuel flow and, when used, the flue gas flow are measured by Hauck's OMG/OMA differential orifice plate along with the aforementioned electronic differential pressure transmitter.

Figure 2:
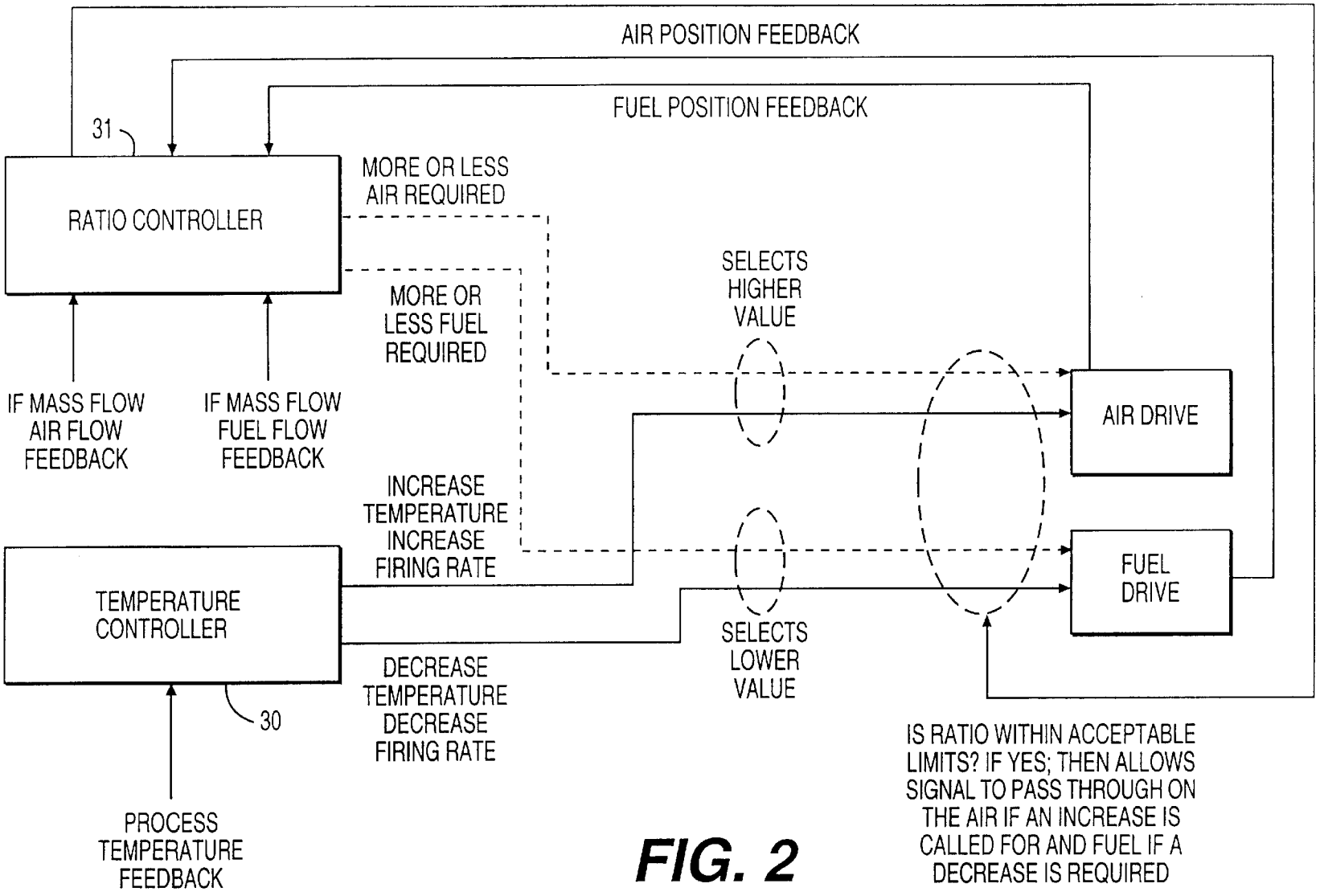
FIG. 2 is a schematic diagram of a mass flow control and electronic programmable linkage logic utilizing conventional components to avoid undesirable rich and lean conditions as a burner encounters increasing and decreasing demand, respectively.

FIG. 2 shows the basic operational principles of mass flow control and electronic programmable linkage control according to the present invention. In particular, the burner control panel 27 includes a temperature controller 30 and a ratio controller 31. Process temperature feedback is provided to the temperature controller 30. The ratio controller 31 compares, during mass flow operation, the inputted measured fuel and air flow and position feedback to a calculated desired fuel/air ratio. If the measured ratio is within acceptable limits, a signal is allowed to pass through "on air" (air drive) if an increase is demanded and "on fuel" (fuel drive) if a decrease is required.

When on air drive, i.e. increased burner output, the ratio controller 31 issues an appropriate signal as to whether more or less air is required, and the temperature controller 30 issues a signal to increase temperature and firing rate. The higher value of the signals for the temperature controller 30 and ratio controller 31 is selected.

Likewise, when on fuel drive, i.e. decreased burner output, the ratio controller 31 issues an appropriate signal as to whether more or less fuel is required, and the temperature controller issues a signal to decrease temperature and firing rate. The system logic selects the lower value of the two signals.

Whereas the mass flow operation uses air and fuel flow feedback, FIG. 2 shows that in the electronic programmable linkage mode, the ratio controller 31 uses air and fuel position feedback. In all other respects, however, the operational principles are the same in both modes.

Figure 3:
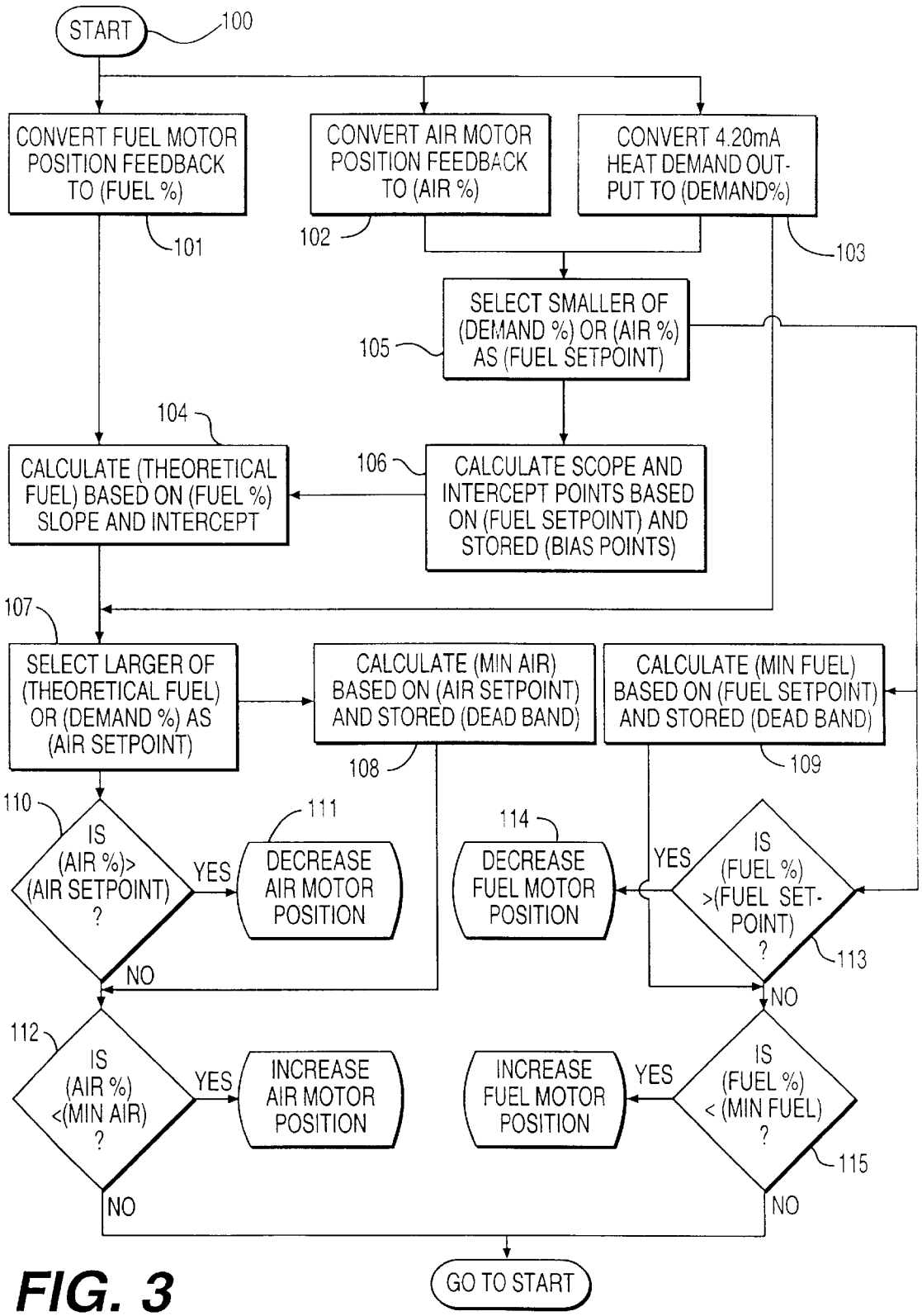
FIG. 3 is a flow diagram of the electronic valve characterization or positioning logic in which valve lagging outside a predetermined angle of travel is avoided.

FIG. 3 shows the basic operational logic of the electronic programmable linkage system which, among other things, prevents the above-described undesired too rich and too lean conditions as well as the valve-lagging condition. This system can be combined with the mass flow system of FIG. 2 as a back-up and integrated into the burner control panel 27 in FIG. 1.

At the start of the process illustrated in FIG. 3, the fuel motor position feedback from system 26 in FIG. 1 is converted to a fuel percentage at Step 101, the air motor position feedback from system 22 is simultaneously converted to an air percentage in Step 102, and a heat demand output is converted to demand percentage in Step 103.

Based upon the determination in Step 101, a theoretical fuel ratio is calculated in Step 104. At Step 105, the logic selects the smaller of the percentage of Step 102 and the demand percentage of Step 103 as the fuel set point. Thereafter in Step 106, the slope and intercept points are stored and used to calculate the theoretical fuel value in Step 104. In Step 107, the larger of theoretical fuel value (Step 104) or demand percentage (Step 103) is selected as the air setpoint and used in Step 108 along with a stored deadband to calculate a minimum air value. The fuel setpoint value (Step 105) is also used in Step 109 along with the stored deadband to calculate a minimum fuel value.

Step 110 decides if the air percentage value (Step 102) is greater than the air setpoint value (Step 107). If yes, then the position of the air motor 22 is decreased in Step 111. If no, Step 112 determines if the air percentage value (Step 102) is less than the calculated minimum fuel value (Step 108). If yes, the position of the air motor 22 is increased, and if no the logic sequence returns to the start position 100.

Meanwhile, the logic decides in Step 113 if the fuel percentage value (Step 101) is greater than the fuel setpoint value (Step 105). If yes, the position of the fuel motor 26 is decreased at Step 114. If no, it is determined in Step 115 if the fuel percentage value (Step 101) is less than the calculated minimum fuel value (Step 109). If yes, the position of the fuel motor 26 is increased, and if no, the system logic returns to the start 100.

As a result of the logic outlined in FIG. 3, an unwanted rich condition is prevented as is the problem of one valve, either the air value or the fuel value, lagging too far behind the other and thereby leading to undesirable lean combustion products in the flue gas.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A system adapted for use in an hot asphalt mix plant, comprising mass flow means for controlling a fuel/air ratio for at least one fuel supplied to a burner by measuring at least two parameters consisting of fuel flow, air flow and flue gas flow, and means for preventing rich operation of the burner when changing burner firing rate and for permitting operation of the burner in lieu of the mass flow means when the latter is non-operational.

2. The system according to claim 1, wherein the mass flow means includes a programmable logic controller for calculating a desired fuel/air ratio based upon the measured fuel and air flows.

3. The system according to claim 1, wherein the right-burner-operation-preventing means comprises an electronic programmable linkage configured to synchronize movement of fuel and air valves for controlling the fuel and air flows, respectively in the event of detected failure of one or more components of the mass flow means.

4. The system according to claim 3, wherein the linkage is arranged to control the air valve via a temperature controller with increased burner output and to control the fuel valve via the temperature controller with decreased burner output.

5. The system according to claim 4, wherein the mass flow means includes a programmable logic controller for calculating a desired fuel/air ratio based upon the measured fuel and air flows.

6. The system according to claim 3, wherein the linkage further includes means for preventing a valve lagging condition producing excessively lean combustion products.

7. The system according to claim 6, wherein the valve lagging condition preventing means is configured to interrupt operations of one of the fuel and air valves being driven by a temperature controller when a desired position of the other of the fuel and air valves lags behind the one valve in excess of a predetermined amount.

8. The system according to claim 7, wherein the mass flow means includes a programmable logic controller for calculate a desired fuel/air ratio based upon the measured fuel and air flows.

9. The system according to claim 7, wherein the linkage is arranged to control the air valve via the temperature controller when burner output is to be increased and to control the fuel valve via the temperature controller when the burner output is to be decreased.

10. A method for characterizing a fuel/air ratio in a burner adapted to be used in a hot mix asphalt plant, comprising the step of controlling mechanically driven air and fuel valves by comparing positions of motors of the air and fuel valves to maintain a predetermined lean condition during adjustment of air and fuel flow of at least one fuel in response to desired burner output such that the air valve is controlled with the fuel valve following the air valve when increasing burner output and the fuel valve is controlled with the air valve following when decreasing burner output.

11. The method according to claim 10, wherein the step of controlling further includes preventing the valve following the controlled valve from lagging behind the latter by more than a predetermined amount.

12. The method according to claim 10, further comprising the step of independently controlling the fuel/air ratio by measuring at least two of fuel flow, air flow and flue gas flow, and calculating at least one of fuel/air ratio and flue gas recirculation ratio.

13. The method according to claim 12, wherein the step of controlling further includes preventing the valve following the controlled valve from lagging behind the latter by more than a predetermined amount.

14. The method according to claim 12, wherein the step of independently controlling is effected via a programmable logic controller.

15. The method according to claim 14, wherein the step of independently controlling includes the step of selectively increasing and decreasing temperature and firing rate in response to process temperature feedback and of selectively increasing and decreasing fuel and air in response to air flow and fuel flow feedback.

* * * * *